US009962006B2

(12) United States Patent
Shih

(10) Patent No.: US 9,962,006 B2
(45) Date of Patent: May 8, 2018

(54) BED BASE CAPABLE OF FIXING MATTRESS

(71) Applicant: Chuan-Hang Shih, Lu-Kang Town (TW)

(72) Inventor: Chuan-Hang Shih, Lu-Kang Town (TW)

( * ) Notice: Subject to any disclaimer, the term of this patent is extended or adjusted under 35 U.S.C. 154(b) by 234 days.

(21) Appl. No.: 14/656,407

(22) Filed: Mar. 12, 2015

(65) Prior Publication Data

US 2016/0262551 A1 Sep. 15, 2016

(51) Int. Cl.
*A47C 19/02* (2006.01)
*A47C 21/02* (2006.01)

(52) U.S. Cl.
CPC ..... *A47C 19/021* (2013.01); *A47C 21/02* (2013.01)

(58) Field of Classification Search
CPC ..... A47C 21/026; A47C 21/02; A47C 21/00; A47C 19/021; A47C 19/02; A47C 19/025
See application file for complete search history.

(56) References Cited

U.S. PATENT DOCUMENTS 809,049 A * 1/1906 Gillett ..... B42F 1/08 24/547
1,031,656 A * 7/1912 Mellon ..... A47C 21/026 5/193
1,125,277 A * 1/1915 Eckerson ..... A47C 21/026 5/193
1,371,098 A * 3/1921 Jones ..... A47C 21/026 5/193
4,017,919 A * 4/1977 Hemmeter ..... A47C 21/026 5/411
5,257,426 A * 11/1993 Leoutsakos ..... A61G 7/053 248/220.1
5,335,385 A * 8/1994 Brown ..... A47C 21/00 5/425
5,737,783 A * 4/1998 Antinori ..... A47C 21/026 248/300
7,607,181 B1 * 10/2009 Harrison ..... A47C 21/026 5/411
8,769,739 B1 * 7/2014 McCarty ..... A47C 21/026 5/193
8,800,079 B1 * 8/2014 Eubank ..... A47C 21/022 5/424
9,044,365 B2 * 6/2015 Rawls-Meehan ..... A61G 7/015
2006/0059629 A1 * 3/2006 Antinori ..... A47C 21/026 5/690
2010/0229309 A1 * 9/2010 Goldsmith ..... A47C 21/026 5/658

(Continued)

*Primary Examiner* — Eric J Kurilla
(74) *Attorney, Agent, or Firm* — Muncy, Geissler, Olds & Lowe, P.C.

(57) ABSTRACT

A bed base capable of fixing mattress includes a base frame and a fixation member. The base frame includes at least one insertion hole. The fixation member includes at least one horizontally extended part, at least one insertion part downwardly extended from an end of the horizontally extended part, and a stopper part upwardly extended from the other end of the horizontally extended part. The insertion part is inserted into the insertion hole of the base frame, the horizontally extended part is placed on a top surface of the base frame, and the stopper part is used to stop at a side edge of the mattress. Therefore, the assembly or disassembly of the fixation member can be achieved without tool assistance.

12 Claims, 10 Drawing Sheets

(56) References Cited

U.S. PATENT DOCUMENTS

| | | | | |
|---|---|---|---|---|
| 2011/0247138 | A1* | 10/2011 | Clenet | A47C 20/04 5/613 |
| 2015/0366362 | A1* | 12/2015 | Scarleski | A47C 21/00 5/658 |
| 2016/0174724 | A1* | 6/2016 | Eskridge, III | A47C 21/026 5/613 |

* cited by examiner

BED BASE CAPABLE OF FIXING MATTRESS

BACKGROUND

1. Technical Field

The present disclosure relates to a bed base, more particularly to a bed base capable of fixing a mattress.

2. Description of Related Art

Referring to FIG. 1, a traditional electric bed 10 is generally provided with a fixation member 12 at a foot portion thereof. The fixation member 12 is fastened on a base frame 16 of the electric bed 10 by two mounting members 14, whereby the fixation member 12 can be used to restrict a position of a mattress 18 placed on the base frame 16. In this way, the mattress 18 is not movable relatively to the electric bed 10 toward the foot portion when the user adjusts the angle of the electric, bed 10 to raise the user's back or downwardly swing the user's legs.

However, after the consumer buys the electric bed 10 and then desires to assemble the fixation member 12, the consumer must use a tool such as a screwdriver, to screw and fasten the two mounting members 14 on the base frame 16, so as to fasten the fixation member 12. However, it not only causes inconvenience and bothers for the consumer, but some consumers have no ideas about operating such tool and cannot assemble the fixation member 12. In particular, it further troubles the consumer whose hand is not convenient to hold the tool due to disease or disability. In addition, after being used for a period of time, the fixation member 12 will become old and rusty and need to be changed; or the fixation member 12 must be detached for conveniently changing a fitted sheet which is used to enclose outside of the mattress 18 and must be cleaned due to being dirty but the tool is also required to detach the fixation member 12. Therefore, the assembly and disassembly of the fixation member 12 of the traditional electric bed 10 are very inconvenient for the consumers. In addition, as functions of the electric bed 10 become more diversified, each of portions of the electric bed may be designed to be changed in various angles or various directions, and even the electric bed is provided with massage function. Therefore, the mattress is not only easily moved toward the foot portion, but also moved toward the bed head or the side edge of the electric bed 10 possibly. Under this circumstance, the traditional fixation member 12 may not be able to certainly fasten the mattress in desired position.

SUMMARY

In order to solve aforesaid problems, an objective of the present disclosure is to provide a bed base capable of fixing a mattress. The bed base comprises at least one fixation member to stop a side edge of the mattress, so as to prevent the mattress from being moved relatively to the bed base. The fixation member can be assembled or disassembled without tool assistance, so its usage convenience is improved, its assembly and disassembly are simpler and quicker, and the fixation member can have reduced manufacturing cost and various modifications.

The bed base capable of fixing mattress, of the present disclosure, comprises a base frame and a fixation member. The base frame is provided with a support part for supporting a mattress, and at least one insertion hole substantially perpendicular to a top surface of the support part. The fixation member is provided with at least one horizontally extended part, at least one insertion part downwardly extended from an end of the at least one horizontally extended part, and a stopper part upwardly extended from the other end of the at least one horizontally extended part. The at least one insertion part is inserted into the at least one insertion hole of the base frame, the at least one horizontally extended part is located on the top surface of the of the support part of the base frame, and the stopper part is used to stop a side edge of the mattress.

When the consumer wants to assemble the fixation member and the base frame together, the consumer just places the insertion part of the fixation member toward the insertion hole of the base frame, and then applies a downward force relatively to the base frame on the fixation member, so that the fixation member can be assembled with the base frame easily to achieve the function of stopping the mattress. On the contrary, when the consumer wants to detach the fixation member from the base frame, the consumer just applies at upward force relatively to the base frame on the fixation member, so that the fixation member can be separated from the base frame easily. Therefore, the consumer can complete assembly or disassembly of the fixation member without tool assistance, the assembly or disassembly of structure of the present disclosure is simpler and quicker than the traditional structure, and the fixation member of the present disclosure can have reduced manufacturing cost and various modifications.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
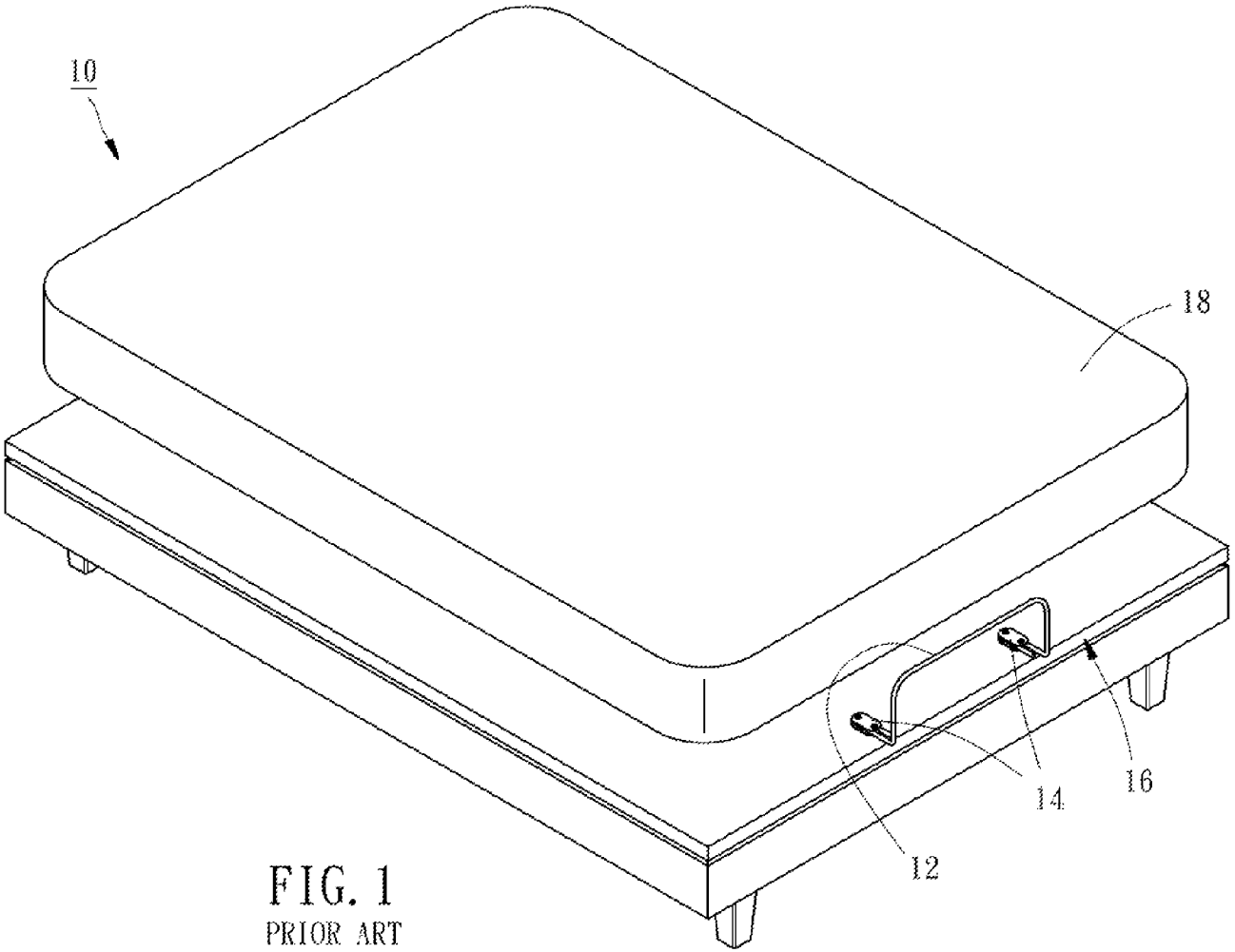
FIG. 1 PRIOR ART
FIG. 1 is a perspective view of a traditional bed base.
Figure 2:
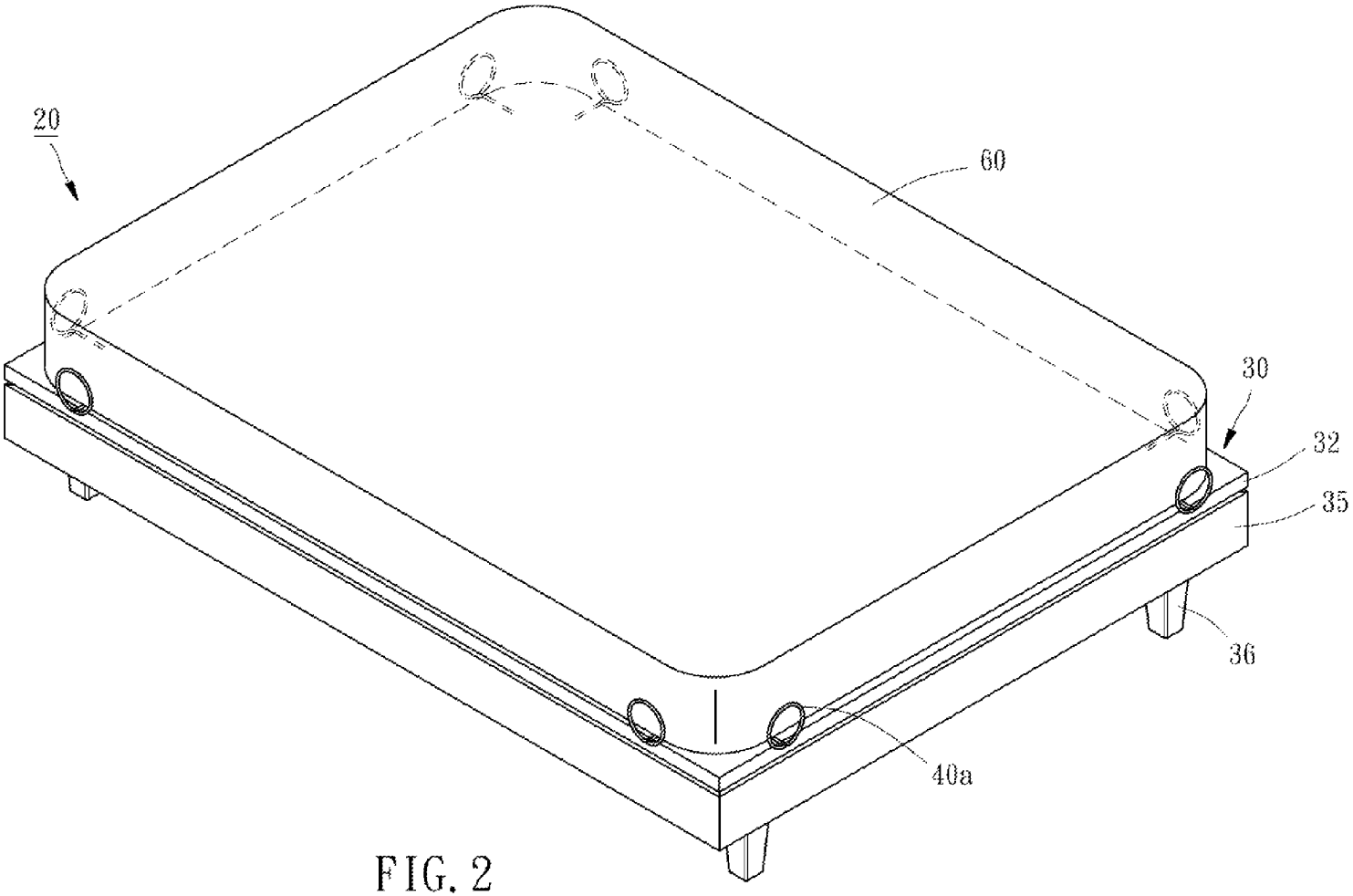
FIG. 2 is a perspective view of a first preferred embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Please refer to FIG. 2 through FIG. 5 which show a bed base 20 capable of fixing a mattress 60, provided by a first preferred embodiment of the present disclosure. The bed base 20 is used to support the mattress 60 and includes a base frame 30, eight fixation members 40*a* and eight bushings 50. In following description, an up direction is defined as an upper portion of the FIG. 2, and a down direction is defined as a lower portion of the FIG. 2.

Figure 5:
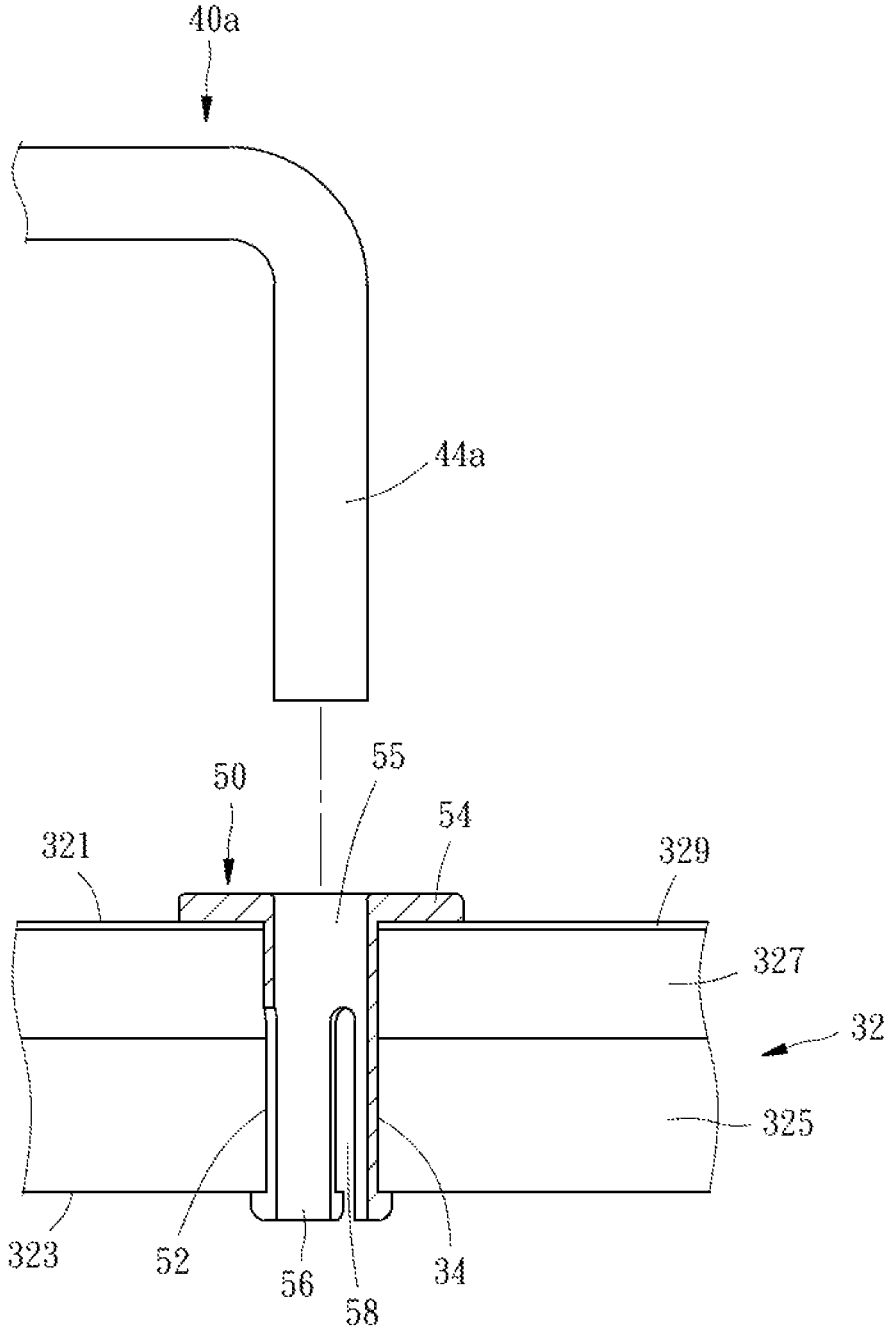
FIG. 5 is a partial cross-sectional view of the first preferred embodiment of the present disclosure.

The base frame 30 includes a support part. 32 for supporting the mattress 60, eight circular insertion holes 34 substantially perpendicular to a top surface 321 of the support part 32 and passed through the support part 32, a bed frame 35 disposed under the support part 32, and four feet 36 of bed downwardly extended from the bed frame 35. As shown in FIG. 5, the support part 32 includes a bottom plate 325, an elastic cushion 327 disposed on the bottom plate 325, and to cover 329 enclosing a surface of the elastic cushion 327. Structures of the base frame 30 and the support part 32 are just examples for this embodiment. However, in other embodiment the structures of the base frame 30 and the support part 32 can be changed or replaced by other material.

Figure 3:
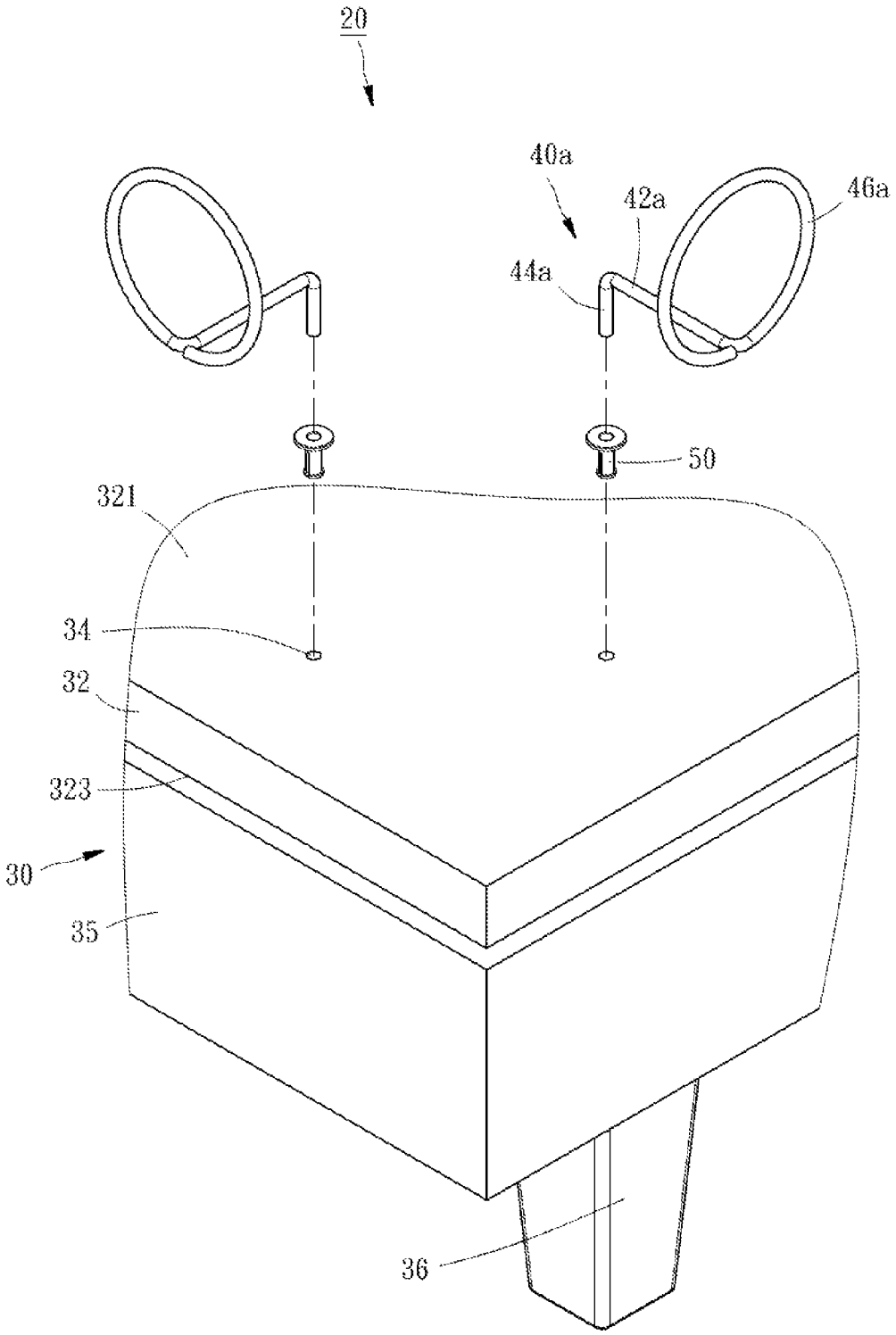
FIG. 3 is an exploded view of a part of the first preferred embodiment of the present disclosure.

Each of the fixation members 40*a* is made integrally and can be made of metal or other material. Referring to FIG. 3, each fixation member 40*a* includes a horizontally extended part 42*a* which is in a rod shape and horizontally extended, an insertion part 44*a* which is in a rod shape and downwardly extended from an end of the horizontally extended part 42*a*, and a stopper part 46*a* which is in a circular shape and upwardly extended from other end of the horizontally extended part 42*a*. The insertion part 44*a* is inserted into the insertion hole 34 of the base frame 30, and a fixation member 40*a* corresponds to an insertion hole 34. After the insertion part 44*a* is inserted into the insertion hole 34, the horizontally extended part 42*a* is placed on the top surface 321 of the support part 32 of the base frame 30, and the stopper part 46*a* is located at a position capable of being stopped at a side edge of the mattress 60. The stopper part 46*a* can be in various shapes.

Figure 4:
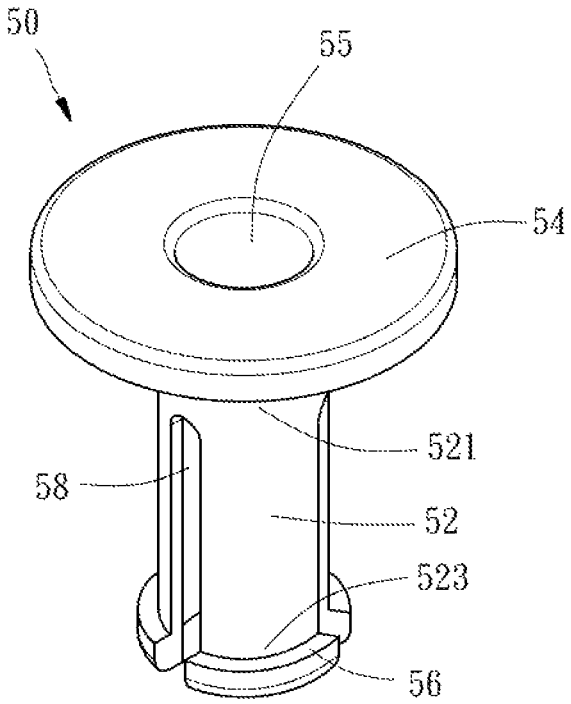
FIG. 4 is a perspective view of a bushing of the first preferred embodiment of the present disclosure.

Please refer to FIG. 4. Each of the bushings 50 includes a body part 52, a top plate 54 radially extended from a top end 521 of the body part 52, a through hole 55 passed through the body part 52 and the top plate 54, a bottom ring 56 radially extended from the bottom end 523 of the body part 52 and three slots 58 extended from the bottom ring 56 to the body part 52. As shown in FIG. 5, the body part 52 is accommodated in the insertion hole 34, the through hole 55 is adapted for being inserted by the insertion part 44*a* of the fixation member 40*a*, the top plate 54 is contacted with the top surface 321 of the support part 32, and the bottom ring 56 is contacted with a bottom 323 of the support part 32. Each of the bushings 50 is mainly used to be abutted against a hole wall of the insertion hole 34, and the insertion part 44*a* can be smoothly inserted into an inner wall of the body part 52 of the bushing 50. The bushing 50 can further be used to hide a rough edge of the insertion hole 34. The slots 58 are designed to enable the body part 52 being elastic to a certain degree. When the manufacturer wants to insert the bushings 50 into the insertion holes 34 respectively, the bottom ring 56 is inserted into the insertion hole 34 first, and the bottom ring 56 will be pushed by the hole wall of the insertion hole 34 to enable the body part 52 being deformed inwardly a little, so the body part 52 can be passed through the insertion hole 34 smoothly. Next, when the bottom ring 56 is kept moving downwardly until the bottom ring 56 is not constrained by the hole wall of the insertion hole 34, the body part 52 can expand outwardly and restore to original position. At this time, the bottom ring 56 is just contacted with the bottom 323 of the support part 32, and the top plate 54 is contacted with the top surface 321 of the support part 32.

According to aforesaid structure, when the consumer wants to assemble the fixation members 40*a* and the base frame 30 together, the consumer can just place the insertion part ha of each fixation member 40*a* toward the body part 52 received in the insertion hole 34 and then apply a downward force relatively to the base frame 30 on the insertion part 44*a* to insert the insertion part 44*a* into the body part 52 received in the insertion hole 34, to enable the horizontally extended part 42*a* to locate on the top surface 321 of the base frame 30, whereby the fixation members 40*a* can be assembled with the base frame 30 easily. Next, the mattress 60 is placed on the bed base 20, and the stopper parts 46*a* can provide function of stopping the mattress 60. In this embodiment, the base frame 30 is provided with two fixation members 40*a* at each of four side edges thereof, so the each of side edges of the mattress 60 can be stopped by the stopper parts 46*a*, such that the mattress 60 is prohibited from moving relatively to the bed base 20. In addition, when the fixation members 40*a* become old and rusty and need to be changed; or the fixation members 40*a* must be detached for conveniently changing a fitted sheet which is used to enclose outside of the mattress 60 and must be cleaned due to being dirty, the consumer can just apply an upward force relatively to the base frame 30 on each of the fixation members 40*a*, and the fixation members 40*a* can be separated from the base frame 30 easily. The consumer can easily complete the assembly or disassembly of the fixation members 40*a* with bare hand without tool assistance, and the assembly or disassembly of the fixation members 40*a* is simpler and quicker than prior art. In addition, because the fixation member 40*a* is formed by bending strip-shaped metal, the manufacturing cost can be reduced and a modeling of the fixation member 40*a* can be varied easily.

The aforesaid structure can be modified based on concept of the present disclosure. For example, the fixation member 40*a* can be one or more in number. The horizontally extended part 42*a* and the insertion part 44*a* of the fixation member 40*a* can be at least one in number. The insertion hole 34 can be at least one in number for being inserted by the fixation member 40*a*. In addition, the bushing 50 and the slot 58 can be at least one in number, the bushing 50 can be provided without the bottom ring 56. In other embodiment, even the bed base 20 can be provided without the bushing 50, and the insertion part 44*a* is directly inserted into the insertion hole 34, but the support part 32 is preferably made of material which hardly forms rough edge of hole after the hole is opened. The insertion hole 34 is not limited to circular shape, so long, as the insertion part 44*a* is not tilted or lopsided after being inserted into the insertion hole 34. In addition, the insertion hole 34 can also not be passed through the support part 32.

Figure 6:
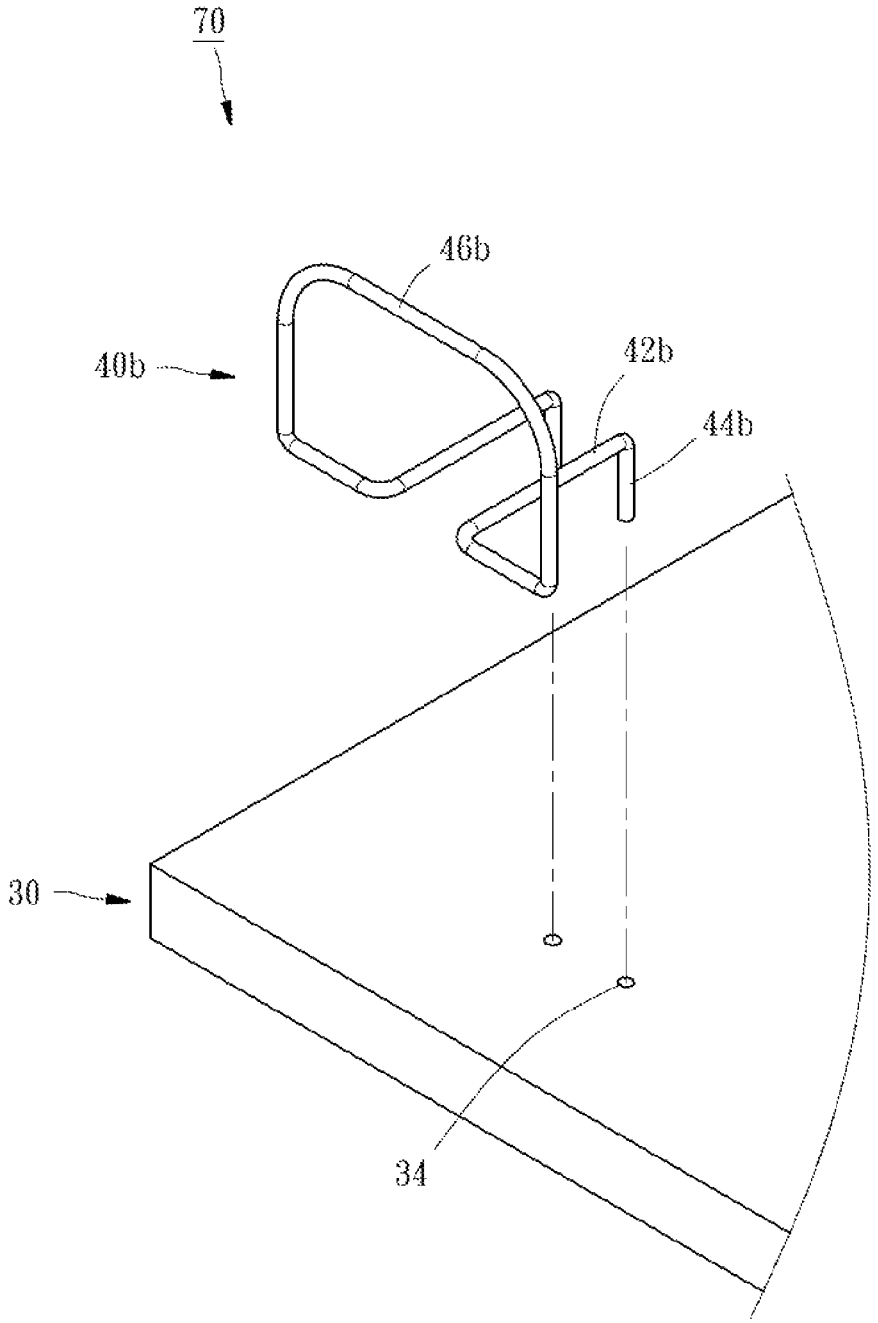
FIG. 6 is a partial perspective view of a base frame and a fixation member of a second preferred embodiment of the present disclosure.
Figure 7:
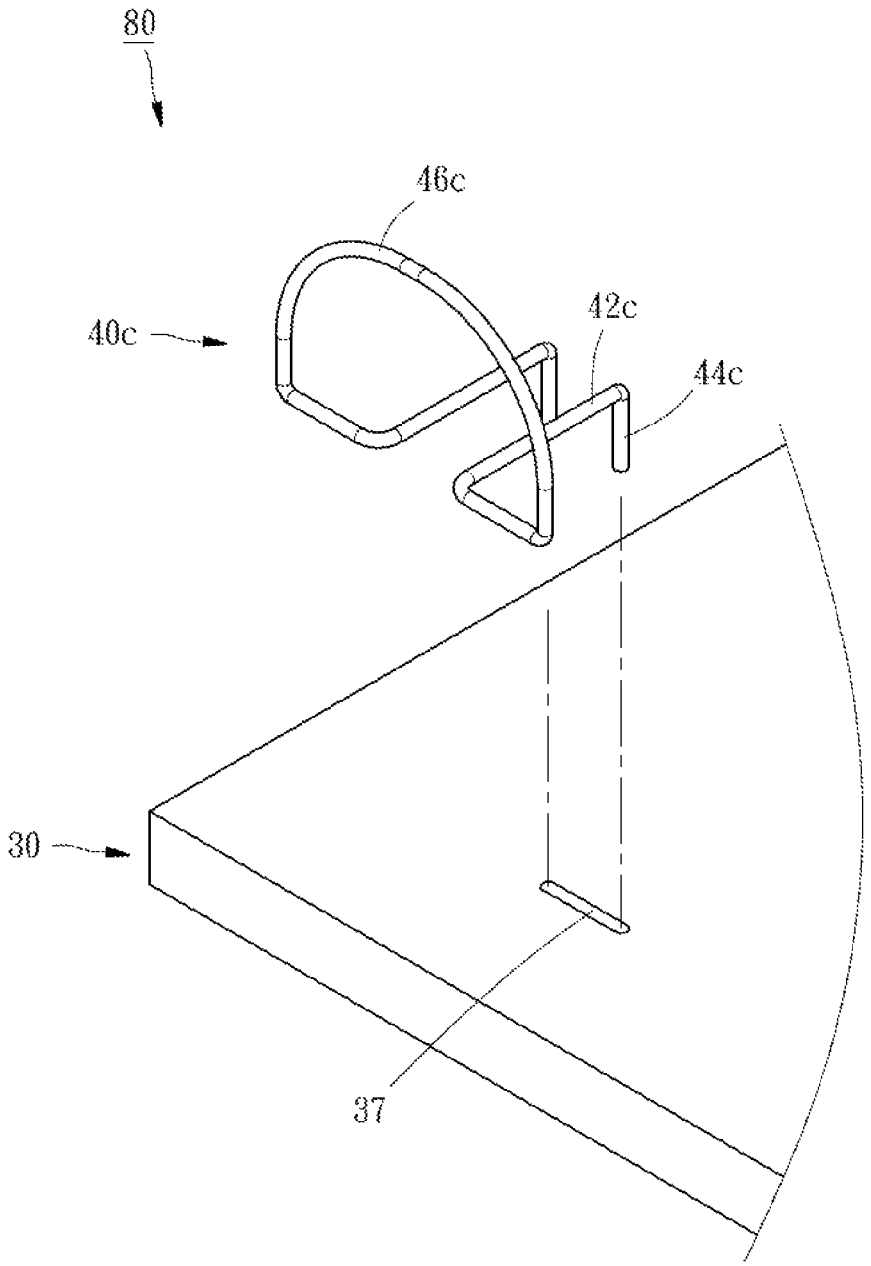
FIG. 7 is a partial perspective view of a base flame and a fixation member of a third preferred embodiment of the present disclosure.

In order to clearly illustrate variations of different structures of the present disclosure, other embodiments taken as examples are described in following paragraph. Please refer to FIG. 6 which is a partial schematic view of a bed base 70 provided by a second preferred embodiment of the present disclosure. The bed base 70 is provided with a base frame 30 and a fixation member 40*b*. The structure of the base frame 30 is similar to that of the first preferred embodiment, but a difference between the second preferred embodiment and the first preferred embodiment is that the base frame 30 is provided with two insertion holes 34 and the fixation member 40*b* is provided with two horizontally extended parts 42*b*, two insertion parts 44*b* and a stopper part 46*b*. The two horizontally extended parts 42*b* are spaced apart by a preset distance, the two insertion parts 44*b* are inserted into the two insertion holes 34 respectively, and the stopper part 46*b* is in a rectangle shape. Therefore, after being assembled together, the fixation member 40*b* and the base frame 30 cannot be rotated relatively to each other like the first preferred embodiment, whereby the mattress can be prevented from being interfered by the fixation member 40*b* while the mattress is placed on the base frame 30. A third preferred embodiment shown in FIG. 7 provides a bed base 80 which is a simple variation of the second preferred embodiment. A stopper part 46*c* of a fixation member 40*c* of the bed base 80 is in a semi-circular shape, the base frame 30 only includes one elongated insertion hole 37 for being inserted by two insertion parts 11*c* of the fixation member 40*c* at the same time. Because the two insertion parts 44*c* are located at two ends of the insertion hole 37 respectively, such structure can prevent the fixation member 40*c* from rotating relatively to the base frame 30.

Figure 8:
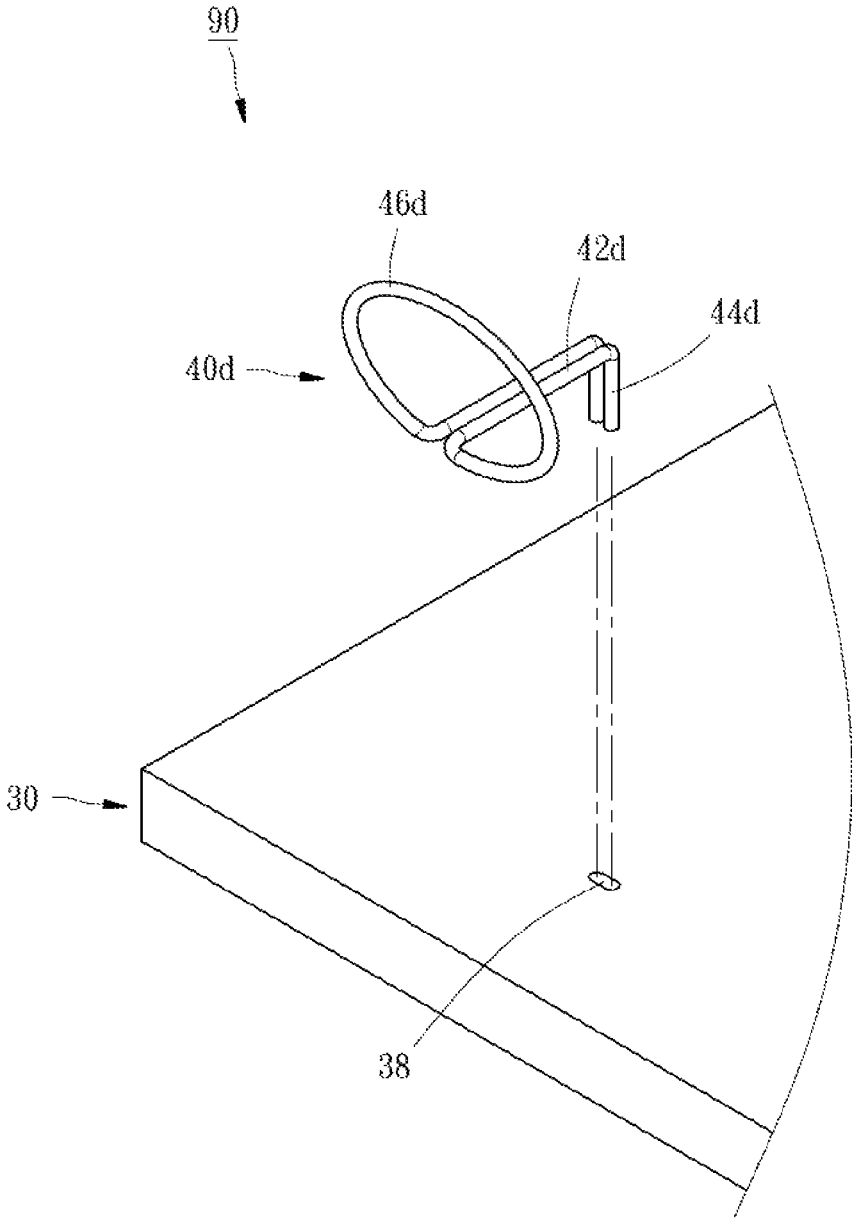
FIG. 8 is a partial perspective view of a base frame and a fixation member of a fourth preferred embodiment of the present disclosure.
Figure 9:
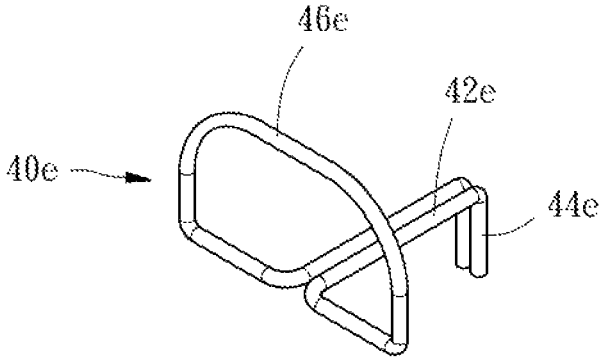
FIG. 9 is a perspective view of a fixation member of a fifth preferred embodiment of the present disclosure.
Figure 10:
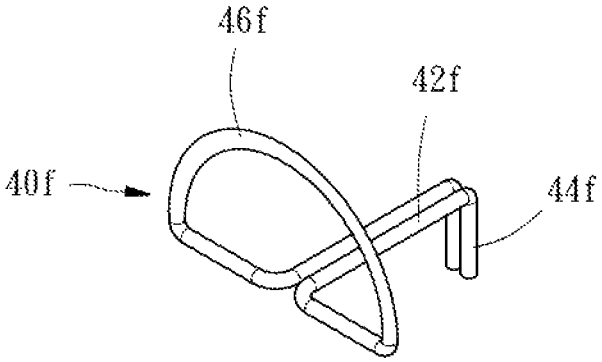
FIG. 10 is a perspective view of a fixation member of a sixth preferred embodiment of the present disclosure.

Please refer to FIG. 8 which is a partial schematic view of a bed base 90 provided by a fourth preferred embodiment of the present disclosure. The bed base 90 includes a base frame 30 and a fixation member 40*d*. The structure of the base frame 30 is similar to that of the first preferred embodiment, but a difference between the fourth preferred embodiment and the first preferred embodiment is that the base frame 30 is provided with an elongated insertion hole 38 and the fixation member 40*d* is provided with two horizontally extended parts 42*d*, two insertion parts 44*d*, and a stopper part 46*d*. The two horizontally extended parts are abutted with each other, the two insertion parts 44*d* are inserted into the insertion hole 38 together, and the stopper part 46*d* is in an elliptical shape. In addition, the elongated insertion holes 37 and 38 can be in other shapes, such as an elliptical shape or a rectangular shape, so long as the insertion parts 44*c* and 44*d* are not tilted or lopsided after being inserted into the elongated insertion holes 37 and 38. Fixation members 40*e* and 40*f* of a bed base provided by one of a fifth preferred embodiment and a sixth preferred embodiment shown in FIG. 9 and FIG. 10 are variations of the fourth preferred embodiment. The stopper parts 46*e* and 46*f* of the fixation members 40*e* and 40*f* are in a rectangle shape and a semi-circular shape, respectively.

The fixation members 40*a* to 40*f* are formed by bending rod-shaped objects made of metal or other material, so the manufacturer can easily vary the numbers of the horizontally extended parts 42*a* to 42*f* and the insertion parts 44*a* to 44*f*, and even vary the shapes of the stopper parts 46*a* to 46*f* during process of manufacturing the fixation members 40*a* to 40*f*. In order to improve a strength of the fixation members 40*a* to 40*f* stopping the mattress 60, iron plates or plastic plates can be used to replace the stopper parts 46*a* to 46*f* and connected with the horizontally extended parts 12*a* to 12*f* by manner of soldering or fastening.

Figure 11:
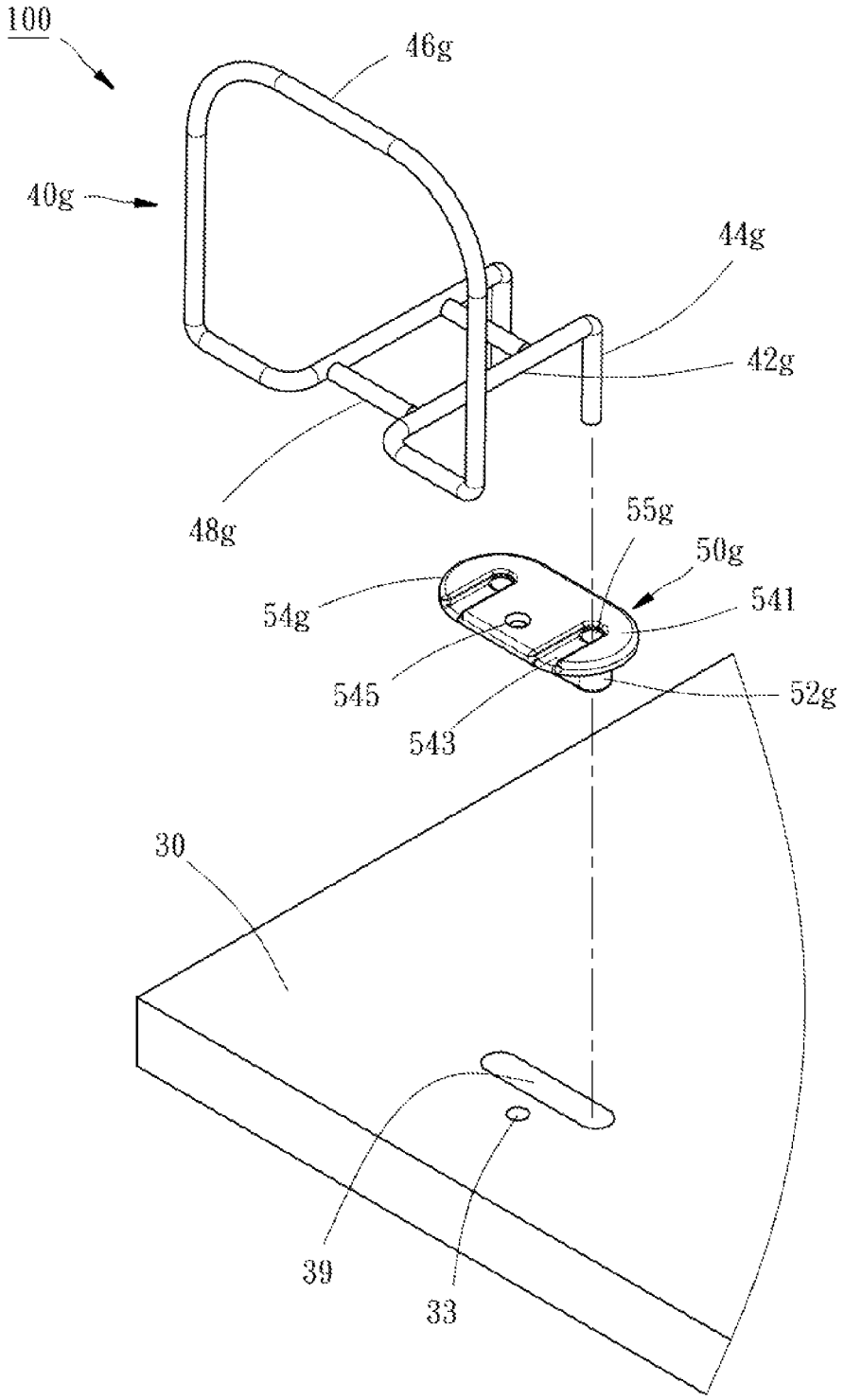
FIG. 11 is a partial perspective view of a base frame, a bushing and a fixation member of a seventh preferred embodiment of the present disclosure.

Please refer to FIG. 11 which is a partial schematic view of a bed base 100 provided by a seventh preferred embodiment of the present disclosure. The bed base 100 is provided with a base flame 30, a fixation member 40*g* and a bushing 50*g*. The structure of the base frame 30 is similar to that of the first preferred embodiment, but a difference between the seventh preferred embodiment and the first preferred embodiment is that the base frame 30 further includes an elongated insertion hole 39 to accommodate a body part 52*g* of the bushing 50*g*. The fixation member 40*g* is provided with two horizontally extended parts 42*g*, two insertion parts 44*g*, a stopper part 46*g* and two connection parts 48. The two horizontally extended parts 42*g* are spaced apart by a preset distance, the stopper part 46*g* is in a rectangle shape, and two ends of the two connection parts 48 are connected to the two horizontally extended parts 42*g*. The bushing 50*g* includes two through holes 55*g* which are passed through the body part 52*g* and the top plate 54*g* and adapted for being inserted by the two insertion parts 44*g* of the fixation member 40*g*. The top plate 54*g* of the bushing 50*g* has a top surface 541, and the top surface 541 is provided with two grooves 543 concavely disposed thereon and communicated with the two through holes 55*g*. Parts of the two horizontally extended parts 42*g* of the fixation member 40*g* are accommodated in the two grooves 543, to constrain the two horizontally extended parts 42*g* in the two grooves 543 respectively. Therefore, when the fixation member 40*g* is contacted with the mattress 60, the two horizontally extended parts 12*g* are not deformed or moved easily due to constraint effect of the two connection parts 48 and the two grooves 543, so that the stop function of the fixation member 40*g* can be strengthened. Aforesaid structure can be varied upon demand, for example, the connection part 48 can be one or more in number, or when the two horizontally extended parts 42*g* are abutted with each other, one groove 543 is sufficient as long as the groove 543 has a sufficient width to accommodate the two horizontally extended parts 42*g*. The two grooves 543 can be communicated with each other to form a wider groove. The two through holes 55*g* can be communicated with each other to form an elongated through hole. In addition, in order to strengthen a stability of the bushing 50*g* mounted on the bed base 30, the bushing 50*g* may include a bottom ring and at least one slot extended from the bottom ring to the body part 52*g*; or, the bushing 50*g* may include a through hole 545 and the bed base 30 may include a through hole 33 corresponding to the through hole 545, such that a screw (not shown) may then penetrate the through hole 545 and the through hole 33 to screw the bushing 50*g* on the bed base 30.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A bed base capable of supporting and fixing a mattress, the bed base comprising:

a base frame provided with a support part for supporting the mattress, and at least one insertion hole having an axial direction substantially perpendicular to a top surface of the support part; and a fixation member provided with at least one horizontally extended part, at least one insertion part downwardly extended from an end of the at least one horizontally extended part and having a straight section, and a stopper part upwardly extended from another end of the at least one horizontally extended part; the at least one insertion part being inserted into the at least one insertion hole of the base frame; the straight section of the at least one insertion part being inserted into the at least one insertion hole in the axial direction and being constrained by an inner periphery of the at least one insertion hole of the base frame; the at least one horizontally extended part being located on the top surface of the support part of the base frame; the stopper part being used to stop a side edge of the mattress.

2. The bed base as defined in claim 1, wherein the base frame comprises two said insertion holes, and the fixation member comprises two said horizontally extended parts and two said insertion parts; the two said insertion parts are inserted into the two said insertion holes respectively.

3. The bed base as defined in claim 2, wherein the two said horizontally extended parts are spaced apart by a distance, and the fixation member is further provided with at least one connection part having two ends connected to the two said horizontally extended parts.

4. The bed base as defined in claim 1, wherein the base frame comprises one said insertion hole which is an elongated insertion hole, and the fixation member comprises two said horizontally extended parts and two said insertion parts; the two said insertion parts are inserted into the elongated insertion hole.

5. The bed base as defined in claim 4, wherein the two said horizontally extended parts are spaced apart by a distance, and the fixation member is further provided with at least one connection part having two ends connected to the two said horizontally extended parts.

6. The bed base as defined in claim 1, wherein the base frame comprises one said insertion hole, and the fixation member comprises one said horizontally extended part and one said insertion part; the one said insertion part is inserted into the one said insertion hole.

7. The bed base as defined in claim 1, further comprising at least one bushing provided with a body part, a top plate radially extended from a top end of the body part, and at least one through hole passed through the body part and the top plate for insertion of the at least one insertion part of the fixation member; the body part is accommodated in the insertion hole, and the top plate is contacted with the top surface of the support part.

8. The bed base as defined in claim 7, wherein the top plate of the bushing is provided at a top surface thereof with at least one groove for receiving a part of the at least one horizontally extended part of the fixation member.

9. The bed base as defined in claim 7, wherein the bushing further comprises a bottom ring radially extended from a bottom end of the body part; the insertion hole of the base frame is passed through the support part, and the bottom ring is contacted with a bottom of the support part.

10. The bed base as defined in claim 9, wherein the top plate of the bushing is provided at a top surface thereof with at least one groove for receiving a part of the at least one horizontally extended part.

11. The bed base as defined in claim 9, wherein the bushing further comprises at least one slot extended from the bottom ring to the body part.

12. The bed base as defined in claim 7, wherein the support part of the base frame comprises a bottom plate, an elastic cushion disposed on the bottom plate, and a cover enclosing a surface of the elastic cushion.

* * * * *